US009145634B2

(12) United States Patent
Erickson

(10) Patent No.: US 9,145,634 B2
(45) Date of Patent: Sep. 29, 2015

(54) METHOD OF OPERATING A LAUNDRY TREATING APPLIANCE

(71) Applicant: Whirlpool Corporation, Benton Harbor, MI (US)

(72) Inventor: Donald E. Erickson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 305 days.

(21) Appl. No.: 13/909,174

(22) Filed: Jun. 4, 2013

(65) Prior Publication Data

US 2014/0352079 A1 Dec. 4, 2014

(51) Int. Cl.

| | |
|---|---|
| ***D06F 35/00*** | (2006.01) |
| ***D06F 33/00*** | (2006.01) |
| ***D06F 33/02*** | (2006.01) |
| ***D06F 37/20*** | (2006.01) |

(52) U.S. Cl.

CPC ..... *D06F 33/00* (2013.01); *D06F 33/02* (2013.01); *D06F 37/203* (2013.01); *D06F 2202/02* (2013.01); *D06F 2202/065* (2013.01); *D06F 2202/10* (2013.01); *D06F 2202/12* (2013.01); *D06F 2204/065* (2013.01); *D06F 2222/00* (2013.01)

(58) Field of Classification Search

USPC ..... 8/158, 159, 137, 147; 68/12.06, 12.02, 68/12.04, 23.1, 140, 13 R, 3 R, 24, 139, 68/23.2, 12.01, 12.27, 12.16; 134/18, 134/25.2, 34, 33, 56 R, 58 R, 85, 120, 23; 422/187, 67, 400, 105, 1, 119, 401, 422/297

See application file for complete search history.

(56) References Cited

U.S. PATENT DOCUMENTS

| | | | | |
|---|---|---|---|---|
| 5,930,855 | A | 8/1999 | Vande Haar et al. | |
| 7,409,738 | B2 | 8/2008 | Borras et al. | |
| 7,603,877 | B2 | 10/2009 | Marioni | |
| 2002/0035757 | A1 * | 3/2002 | Ciancimino et al. | 8/159 |
| 2007/0039106 | A1 * | 2/2007 | Stansel et al. | 8/159 |
| 2009/0249560 | A1 | 10/2009 | Gaulter et al. | |
| 2012/0017646 | A1 * | 1/2012 | Chae et al. | 68/12.02 |

FOREIGN PATENT DOCUMENTS

| | | | |
|---|---|---|---|
| CN | 1920155 | A | 2/2007 |
| DE | 102005037144 | A1 | 8/2006 |
| DE | 202007002626 | U1 | 4/2007 |
| EP | 1736589 | A2 | 12/2006 |
| EP | 2103726 | B1 | 3/2011 |
| JP | 2168992 | A | 6/1990 |

OTHER PUBLICATIONS

German Search Report for Counterpart DE102014107695.8, dated Dec. 4, 2014.

* cited by examiner

*Primary Examiner* — Michael Barr
*Assistant Examiner* — Thomas Bucci

(57) ABSTRACT

A method of operating a laundry treating appliance having a chassis, a tub, a rotatable drum positioned within the tub, and a suspension system mounting the tub to the chassis, with the rotatable drum at least partially defining a treating chamber for receiving laundry for treatment according to an automatic cycle of operation, and the tub, drum, and any laundry in the treating chamber forming a suspended mass in combination with the suspension system, the method includes accelerating the drum such that an unacceptable imbalance of laundry in the drum will present as the drum contacting a portion of the chassis twice.

13 Claims, 6 Drawing Sheets

METHOD OF OPERATING A LAUNDRY TREATING APPLIANCE

BACKGROUND

Laundry treating appliances, such as clothes washers, refreshers, and non-aqueous systems, may have a configuration based on a rotating drum that defines a treating chamber in which laundry items are placed for treating. The drum of the laundry treating appliance may be rotated at a high rate of speed. At such high speeds, an imbalance may result in unacceptable vibratory movement of the drum and the entire laundry treating appliance. The tub and drum may move enough such that the tub reaches the limit of its suspension and/or contacts the surrounding cabinet structure, referred to as a "hit," with consequent noise and possible damage.

BRIEF SUMMARY

An embodiment of the invention relates to a method of operating a laundry treating appliance having a chassis, a tub, a rotatable drum positioned within the tub, and a suspension system mounting the tub to the chassis, with the rotatable drum at least partially defining a treating chamber for receiving laundry for treatment according to an automatic cycle of operation, and the tub, drum, and any laundry in the treating chamber forming a suspended mass in combination with the suspension system, the method includes accelerating a rotational speed of the drum through a resonance speed zone of the suspended mass where an unacceptable imbalance of laundry in the drum will present as the drum contacting a portion of the chassis to define a "hit", identifying when the monitored movements satisfy a predetermined threshold, indicative of a hit, for two sequential time segments, which correspond to a rotational frequency of the drum during the resonance speed zone, to identify a double hit, and ceasing the accelerating of the drum upon the identification of a double hit.

DETAILED DESCRIPTION

Figure 1:
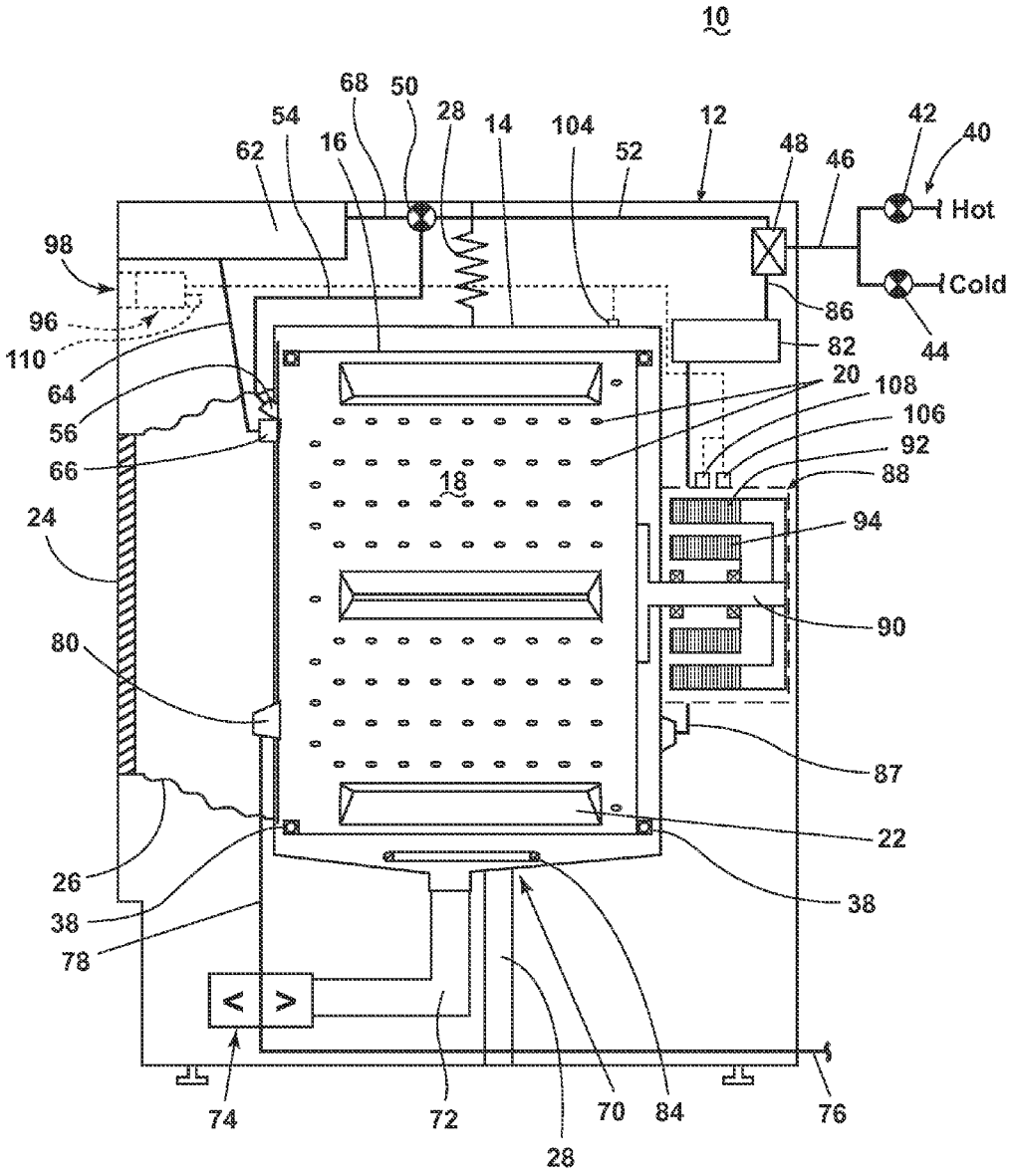
FIG. 1 is a schematic view of a laundry treating appliance in the form of a washing machine.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a chassis or cabinet 12 which defines a housing within which a laundry holding system resides. The cabinet 12 may define an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a drum 16 provided within the tub 14, the drum 16 defining at least a portion of a laundry treating chamber 18 for receiving a laundry load for treatment. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to include only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system. Including that the suspension system 28 may mount the tub 14 to the cabinet 12.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled with the rotating drum 16 and configured to compensate for a dynamic imbalance during rotation of the rotatable drum 16. The balancing material may be in the form of balls, fluid, or a combination thereof. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled with opposite ends of the rotatable drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation. Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
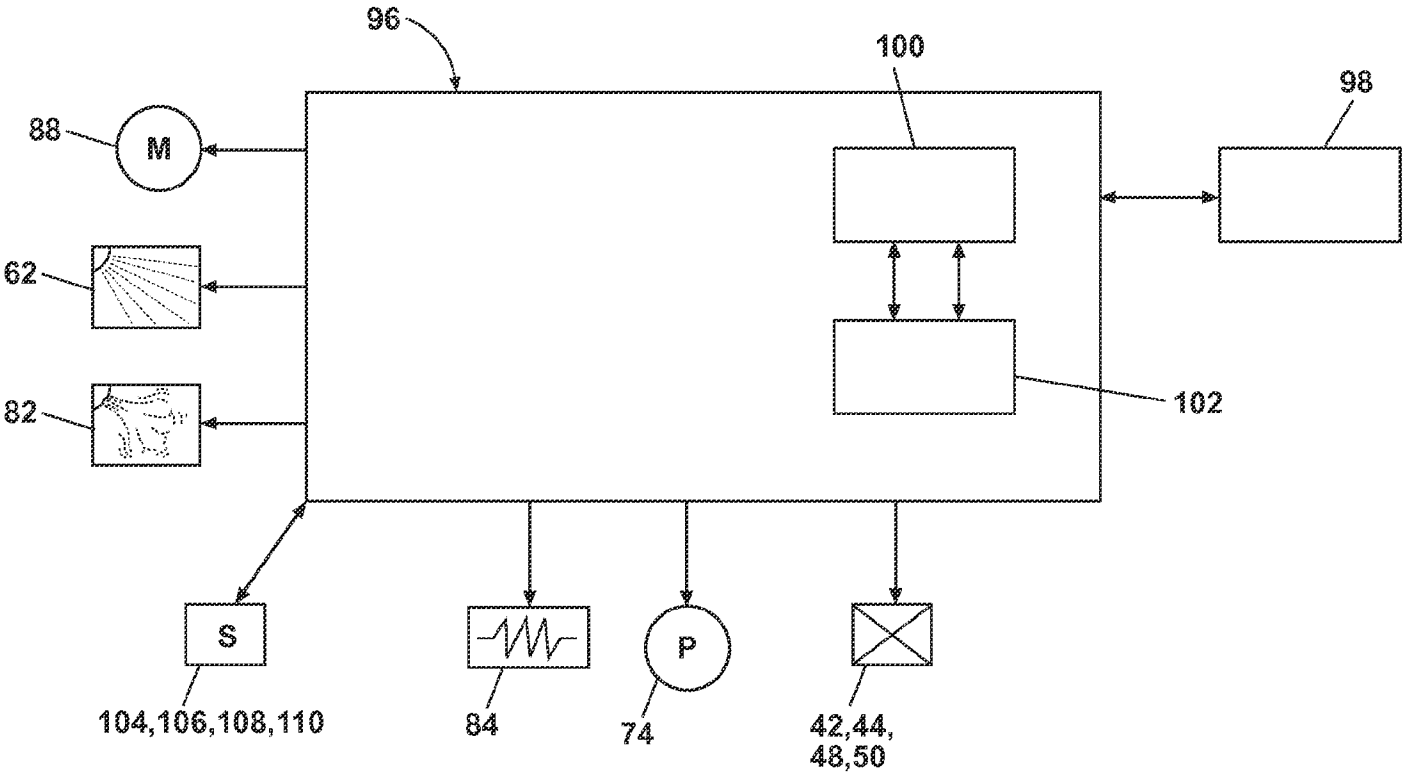
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that may be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input. For example, a table of a plurality of threshold values 120 may be included.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, a load size sensor, and a motor torque sensor, which may be used to determine a variety of system and laundry characteristics, such as laundry load inertia or mass.

In one example, a motor sensor such as a motor torque sensor 106 may also be included in the washing machine 10 and may provide a torque output indicative of the torque applied by the motor 88. The motor torque is a function of the inertia of the rotating drum 16 and the laundry load. The motor torque sensor 106 may also include a motor controller or similar data output on the motor 88 that provides data communication with the motor 88 and outputs motor characteristic information, generally in the form of an analog or digital signal, to the controller 96 that may be indicative of the applied torque. The controller 96 may use the motor characteristic information to determine the torque applied by the motor 88 using software that may be stored in the controller memory 100. Specifically, the motor torque sensor 106 may be any suitable sensor, such as a voltage or current sensor, for outputting a current or voltage signal indicative of the current or voltage supplied to the motor 88 to determine the torque applied by the motor 88. Additionally, the motor torque sensor 106 may be a physical sensor or may be integrated with the motor and combined with the capability of the controller 96, or may function as a sensor. For example, motor characteristics, such as speed, current, voltage, torque etc., may be processed such that the data provides information in the same manner as a separate physical sensor. In contemporary motors, the motors often have their own controller that outputs data for such information.

As another example, a speed sensor 108 may also be included in the washing machine 10 and may be positioned in any suitable location for detecting and providing a speed output indicative of a rotational speed of the drum 16. Such a speed sensor 108 may be any suitable speed sensor capable of providing an output indicative of the speed of the drum 16. It is also contemplated that the rotational speed of the drum 16 may also be determined based on a motor speed; thus, the speed sensor 108 may include a motor speed sensor for determining a speed output indicative of the rotational speed of the motor 88. The motor speed sensor may be a separate component, or may be integrated directly into the motor 88. Regardless of the type of speed sensor employed, or the coupling of the drum 16 with the motor 88, the speed sensor 108 may be adapted to enable the controller 96 to determine the rotational speed of the drum 16 from the rotational speed of the motor 88.

Furthermore, a sensor 110 may be coupled with the cabinet 12 and operably coupled with the controller 96. The sensor 110 may be configured to monitor the movement of the cabinet 12. The sensor 110 may be mounted in any suitable location to monitor the movement of the cabinet and has been illustrated as being coupled with the controller 96. Any suitable type of sensor may be used including that the sensor 110 may include an accelerometer. The accelerometer may be capable of outputting any suitable signal to indicate the movement of the cabinet 12 including that the accelerometer may output a signal indicating detected acceleration forces as well as a digital signal that the cabinet 12 has been hit a predetermined number of times.

Prior to describing a method of operation of the washing machine 10, a brief summary of the underlying physical phenomena may be useful to aid in the overall understanding. The motor 88 may rotate the drum 16 at various speeds in either rotational direction. In particular, the motor 88 may rotate the drum 16 at speeds to effect various types of laundry load 112 movement inside the drum 16. For example, the laundry load may undergo at least one of tumbling, rolling (also called balling), sliding, satellizing (also called plastering), and combinations thereof. During tumbling, the drum 16 may be rotated at a tumbling speed such that the fabric items in the drum 16 rotate with the drum 16 from a lowest location of the drum 16 towards a highest location of the drum 16, but fall back to the lowest location before reaching the highest location. Typically, the centrifugal force applied by the drum to the fabric items at the tumbling speeds is less than about 1G. During satellizing, the motor 88 may rotate the drum 16 at rotational speeds, i.e. a spin speed, wherein the fabric items are held against the inner surface of the drum and rotate with the drum 16 without falling. This is known as the laundry being satellized or plastered against the drum. Typically, the force applied to the fabric items at the satellizing speeds is greater than or about equal to 1G. For a horizontal axis washing machine 10, the drum 16 may rotate about an axis that is inclined relative to the horizontal, in which case the term "1G" refers to the vertical component of the centrifugal force vector, and the total magnitude along the centrifugal force vector would therefore be greater than 1G. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 16 may be facilitated by the baffles 22.

Centrifugal force (CF) is a function of a mass (m) of an object (laundry item 116), an angular velocity ($\omega$) of the object, and a distance, or radius (r) at which the object is located with respect to an axis of rotation, or a drum axis. Specifically, the equation for the centrifugal force (CF) acting on a laundry item 116 within the drum 16 is:

$$CF=m*\omega^2*r \quad (1)$$

The centrifugal force (CF) acting on any single item 116 in the laundry load 112 may be modeled by the distance the center of gravity of that item 116 may be from the axis of rotation of the drum 16. Thus, when the laundry items 116 are stacked upon each other, which is often the case, those items having a center of gravity closer to the axis of rotation experience a smaller magnitude centrifugal force (CF) than those items having a center of gravity farther away. It may be possible to slow the speed of rotation of the drum 16 such that the closer items 116 will experience a centrifugal force (CF) less than the force required to satellize them, permitting them to tumble, while the farther away items 116 still experience a centrifugal force (CF) equal to or greater than the force required to satellize them, retaining them in a fixed position relative to the drum 16. Using such a control of the speed of the drum 16, it may be possible to control the speed of the drum 16 such that the closer items 116 may tumble within the drum 16 while the farther items 116 remain fixed. This method may be used to eliminate an imbalance 114 caused by a mass of stacked laundry items 116 because an imbalance may often be caused by a localized "piling" of items 116.

As used in this description, the elimination of the imbalance 114 means that the imbalance 114 may be reduced below a maximum magnitude suitable for the operating conditions. It does not require a complete removal of the imbalance 114. In many cases, the suspension system 28 in the washing machine 10 may accommodate a certain amount of imbalance 114. Thus, it is not necessary to completely remove the entire imbalance 114.

Figure 3:
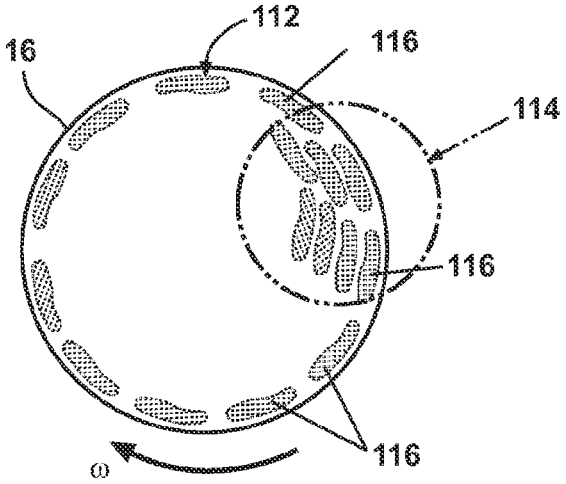
FIG. 3 schematically illustrates a laundry load, including an imbalance, in a drum of the laundry treating appliance of FIG. 1.
Figure 4:
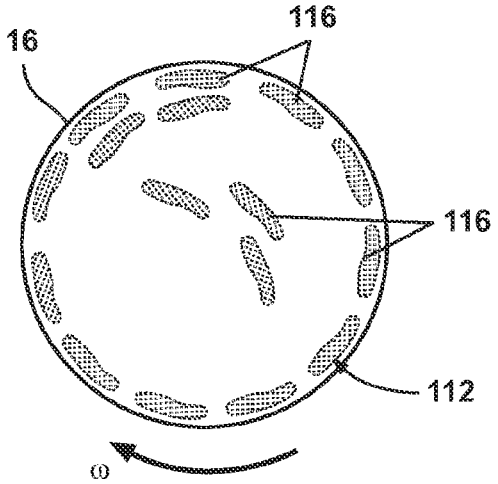
FIG. 4 schematically illustrates the position of the laundry load in the drum as it is redistributed.
Figure 5:
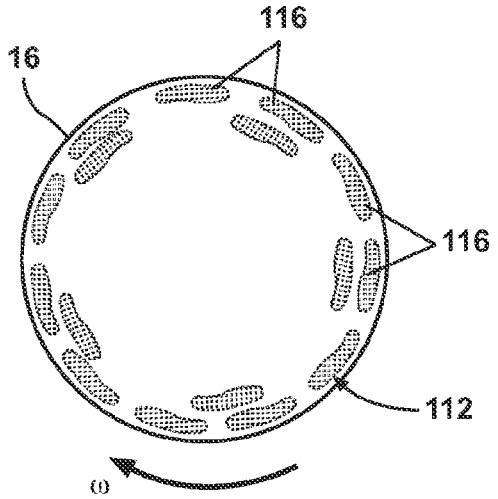
FIG. 5 schematically illustrates the position of the laundry load in the drum after the imbalance has been sufficiently eliminated.

FIGS. 3-5 graphically illustrate such a method. Beginning with FIG. 3, an unequally distributed laundry load 112 is shown in the treating chamber 18 defined by the drum 16 during a spin phase wherein the treating chamber 18 may be rotated at a spin speed sufficient to apply a centrifugal force greater than that required to satellize the entire laundry load 112, thereby, satellizing the laundry load 112. However, it may also be seen that not all the laundry items 116 that make up the laundry load 112 are located an equal distance from the axis of rotation. Following the above equation, the centrifugal force (CF) acting on each laundry item 116 in the treating chamber 18 may be proportional to the distance from the axis of rotation. Thus, along the radius of the treating chamber 18, the centrifugal force (CF) exhibited on the individual laundry items 116 will vary. Accordingly, the closer the laundry item 116 lies to the axis of rotation, the smaller the centrifugal force (CF) acting thereon. Therefore, to satellize all of the laundry items 116, the treating chamber 18 must be rotated at a spin speed sufficient that the centrifugal force (CF) acting on all of the laundry items 116 may be greater than the gravity force acting thereon. It may be correlated that the laundry items 116 pressed against the inner peripheral wall of the treating chamber 18 experience greater centrifugal force (CF) than the laundry items 116 lying closer to the axis of rotation. In other words, during the spin phase and satellization of the laundry load 112, all of the laundry items 116 are experiencing centrifugal force greater than the force required to satellize them, yet not all of the laundry items 116 are experiencing the same centrifugal force (CF).

The imbalance 114 may be seen in the treating chamber 18, as circled in FIG. 3. The imbalance 114 may be due to the uneven distribution of the laundry items 116 within the treating chamber 18. Further, the laundry items 116 that create the imbalance 114 will necessarily be those laundry items 116 that are closest to the axis of rotation. FIG. 4 illustrates the position of the laundry load 112 in the treating chamber 18 during a redistribution phase wherein the treating chamber 18 may be slowed from the speed of FIG. 3 and rotated at a speed such that some of the laundry items 116 experience less than a centrifugal force required to satellize them, while the remaining laundry items 116 experience a centrifugal force required to satellize them or greater than a centrifugal force required to satellize them. According to the principals described above, as the rotational speed of the treating chamber 18 may be reduced, the laundry item 116 or items that contributed to the imbalance 114 will begin to tumble and will be redistributed. Upon redistribution, the treating chamber 18 may be accelerated once again to a speed sufficient to satellize all of the laundry items 116. FIG. 5 illustrates the position where the imbalance 114 may be eliminated by a sufficient redistribution and the rotational speed of the treating chamber 18 has been increased again to the spin speed sufficient to satellize the entire laundry load 112.

The deceleration of the drum 16 and acceleration of the drum 16 may include the controller 96 operating the motor 88 such that the speed of the drum 16 may be dropped just below the satellizing speed and then brought back up to the satellizing speed such that the speed of the drum 16 oscillates around the satellizing speed, this is sometimes referred to as a short distribution. Alternatively, the deceleration of the drum 16 and acceleration of the drum 16 may include the controller 96 stopping the rotation of the drum 16 altogether and then bringing the drum 16 back up to the satellizing speed, this is sometimes referred to as a long distribution. Regardless of the type of distribution, an accurate satellizing speed may be beneficial for the controller 96 to have and use. If the determined satellizing speed is lower than the actual satellizing speed, the controller 96 may attempt to satellize the laundry items and the laundry items may instead tumble. If the determined satellizing speed is higher than the actual satellizing speed, the controller 96 may attempt to redistribute the laundry by tumbling some of the laundry items and the laundry items may instead remain plastered to the drum 16.

The tub 14, drum 16, and any laundry items 116 in the treating chamber 18 form a suspended mass in combination with the suspension system 28. An imbalance may cause the suspended mass to move within the cabinet 12 and potentially "hit" the sides and/or top of the cabinet 12 depending on the natural frequencies of the washing machine 10 and the rotational speed of the drum 16. The laundry treating appliance may be affected severely enough that it may "walk" across the floor and cause floor vibration.

Figure 6:
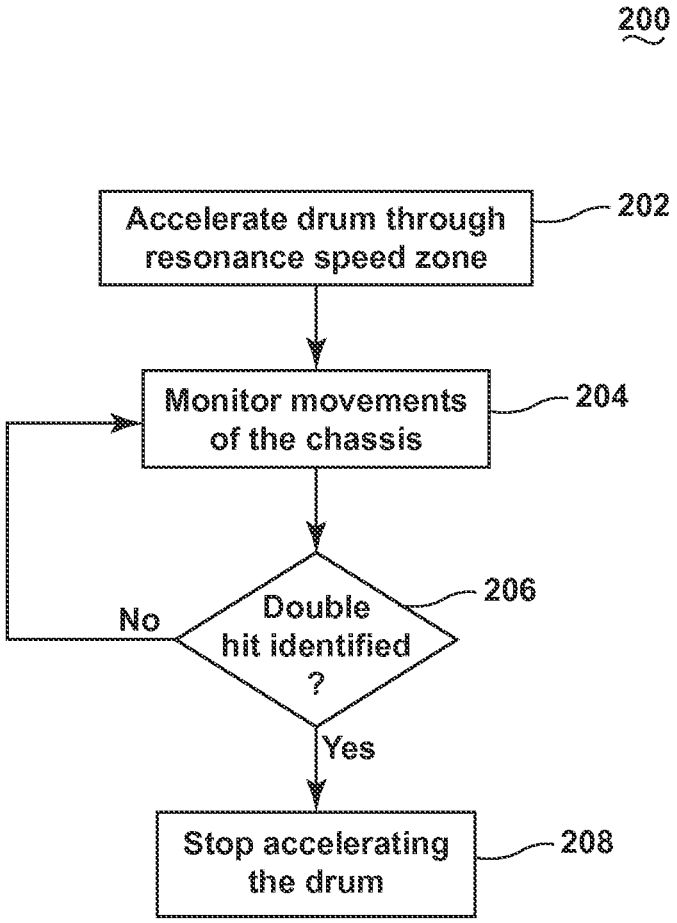
FIG. 6 is a flow chart illustrating a method of operating the laundry treating appliance such as the washing machine in FIG. 1 according to an embodiment of the invention.

FIG. 6 illustrates a flow chart of a method 200 for operating a laundry treating appliance, such as the washing machine 10, that may result in improved detection of cabinet hits and reduce the detection of nuisance hits, which may cause unnecessary redistribution, and walking of the laundry treating appliance. The sequence of steps depicted for this method is for illustrative purposes only, and is not meant to limit the method in any way as it is understood that the steps may proceed in a different logical order or additional or intervening steps may be included without detracting from the invention. The method 200 starts with assuming that the user has placed one or more laundry items 116 for treatment within the treating chamber 18 and selected a cycle of operation through the user interface 98.

At 202, the controller 96 may accelerate the drum 16 through operation of the motor 88 to rotate the drum 16 through a resonance speed zone of the suspended mass where an unacceptable imbalance of laundry in the drum 16 will present as the drum 16 and tub 14 assembly or the suspended mass contacting a portion of the cabinet 12 to define a "hit." Accelerating the drum 16 may include the drum 16 being rotated by the motor 88 from a non-satellizing speed to a satellizing speed and through the resonance speed zone of the suspended mass. It is contemplated that the resonance speed zone may be a predetermined speed or may be a speed at which the controller 96 determines movement of the suspended mass or the laundry treating appliance. The resonance speed zone for the illustrated embodiment may include any zone including a zone between 100 and 300 revolutions per minute of the drum 16. It will be understood that the resonance speed zone may differ between different laundry treating appliances and that the resonance speed zone may correlate to various movements of the laundry treating appliance. For example, the resonance speed zone may include speeds causing side-to-side movement of the suspended mass. The side to side movement is in a plane passing through the axis of rotation of the drum 16. Other types of movement may include front to back movement of the drum and up and down movement of the drum. Each different movement correlates to a different resonance speed zone.

While the drum 16 is accelerated through the resonance speed zone the controller 96 may monitor movements of the cabinet 12, as indicated at 204. Monitoring the movements of the cabinet 12 may include monitoring the acceleration of the cabinet 12 such as by receiving output from the sensor 110, which may be an accelerometer, coupled with the cabinet 12.

At 206, the controller 96 may identify when the monitored movements satisfies a predetermined threshold, indicative of a hit, for two sequential time segments, which correspond to a rotational frequency of the drum 16 during the resonance speed zone, to identify a double hit. The controller 96 may accomplish this by comparing the monitored movements of the cabinet 12 to a predetermined threshold to see if the monitored amount satisfies the predetermined threshold. To do this, the controller 96 may compare the monitored amount to the predetermined threshold value. The term "satisfies" the threshold is used herein to mean that the amount of movement satisfies the predetermined threshold, such as being equal to or greater than the threshold value. It will be understood that such a determination may easily be altered to be satisfied by a positive/negative comparison or a true/false comparison. The predetermined threshold may include a predetermined acceleration magnitude, which may be indicative of a hit. Furthermore, the identifying at 206 may include determining a frequency of the hits to determine if the hits correspond to a rotational frequency of the drum 16. In this manner, identifying the double hit may include determining if the two hits exceed a magnitude threshold and determining if the two hits are at a specific timing. It is contemplated that the controller 96 may determine if the double hit may be present by processing a signal from the accelerometer or sensor 110. Alternatively, the accelerometer 110 may be configured to output a signal indicating that the hits are within a predetermined frequency and have met the predetermined magnitude threshold. It may also be within the scope of embodiments of the invention for the accelerometer 110 to have a memory and a microprocessor for storing information and software and executing the software, respectively. The accelerometer would merely need to be programmed with the parameters of the predetermined magnitude threshold and the frequency threshold in order to output whether a double hit had occurred. In either case, it will be understood that the controller 96 may identify that the double hit has occurred even this merely includes identifying whether the output from the accelerometer indicates a double hit.

It is contemplated that the two sequential time segments may include a first time segment corresponding to a single rotation of the drum 16 and a second time segment corresponding to a single rotation of the drum 16. In this manner, the two sequential time segments correlate to two sequential rotations of the drum 16 and hits may be determined at the first and second rotations of the drum 16. Alternatively, the first of the two sequential time segments may correlate to two, sequential rotations of the drum 16 and the second of the two sequential time segments may correlate to a single rotation of the drum 16. In such an instance the two sequential time segments are not of the same length and equal a total of three sequential rotations of the drum 16 and hits may be determined at the first and third rotations of the drum 16. In this manner it may be determined when a double hit has been identified. If a double hit has not been identified, then the method continues on to identify a double hit. If a double hit has been identified, then the method moves forward and at 208 the accelerating of the drum 16 may be ceased. Ceasing the acceleration of the drum 16 may include stopping rotation of the drum 16 or slowing the speed of rotation of the drum 16.

It will be understood that the method of operating the laundry treating appliance may be flexible and that the method 200 illustrated is merely for illustrative purposes. For example, it is contemplated that the controller 96 may operate the motor 88 to reverse a rotational direction of the drum 16 after the accelerating has been ceased. By way of additional example, the controller 96 may operate to redistribute the laundry within the drum 16 after the accelerating has been ceased. Further, while portions of the method and description thus far have been specific to a washing machine it will be understood that embodiments of the invention may be utilized with any suitable laundry treating appliance.

Figure 7:
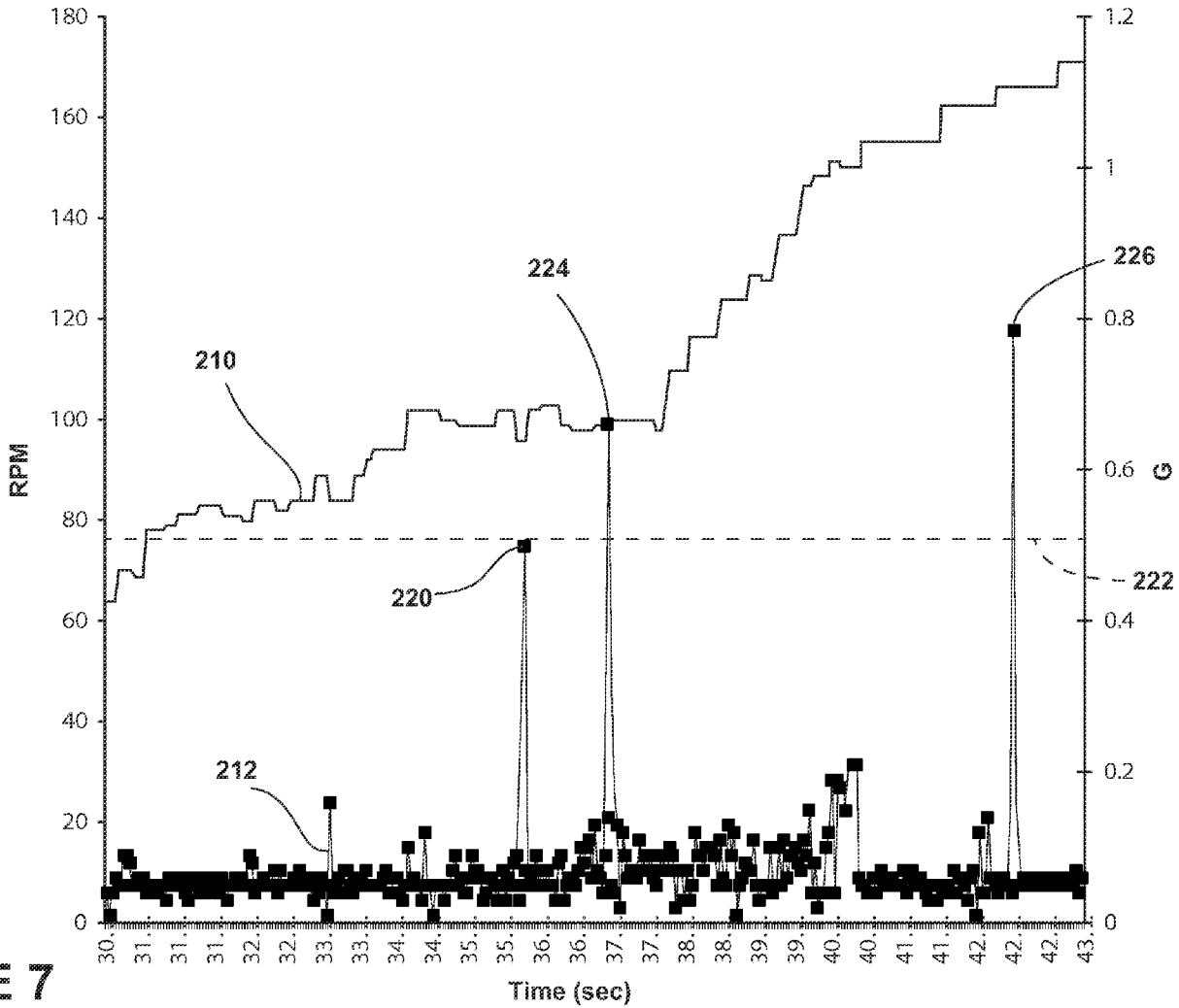
FIG. 7 is a graph illustrating when a double hit would not be identified according to an embodiment of the method.

FIG. 7 is a graph illustrating several cabinet hits that would not cause a double hit to be identified. More specifically, a rotational speed 210 of the drum 16 is illustrated along with a signal illustrating the movement or acceleration 212 of the cabinet 12. A first hit 220 is shown as being below a predetermined acceleration magnitude 222 and would be dismissed as not satisfying the predetermined threshold. The second hit 224 and the third hit 226 are both above the predetermined acceleration magnitude 222; however, the frequency of the hits is not such that they would be determined to be two sequential time segments, which correspond to a rotational frequency of the drum during the resonance speed zone. Thus, the acceleration of the drum 16 may continue.

Figure 8:
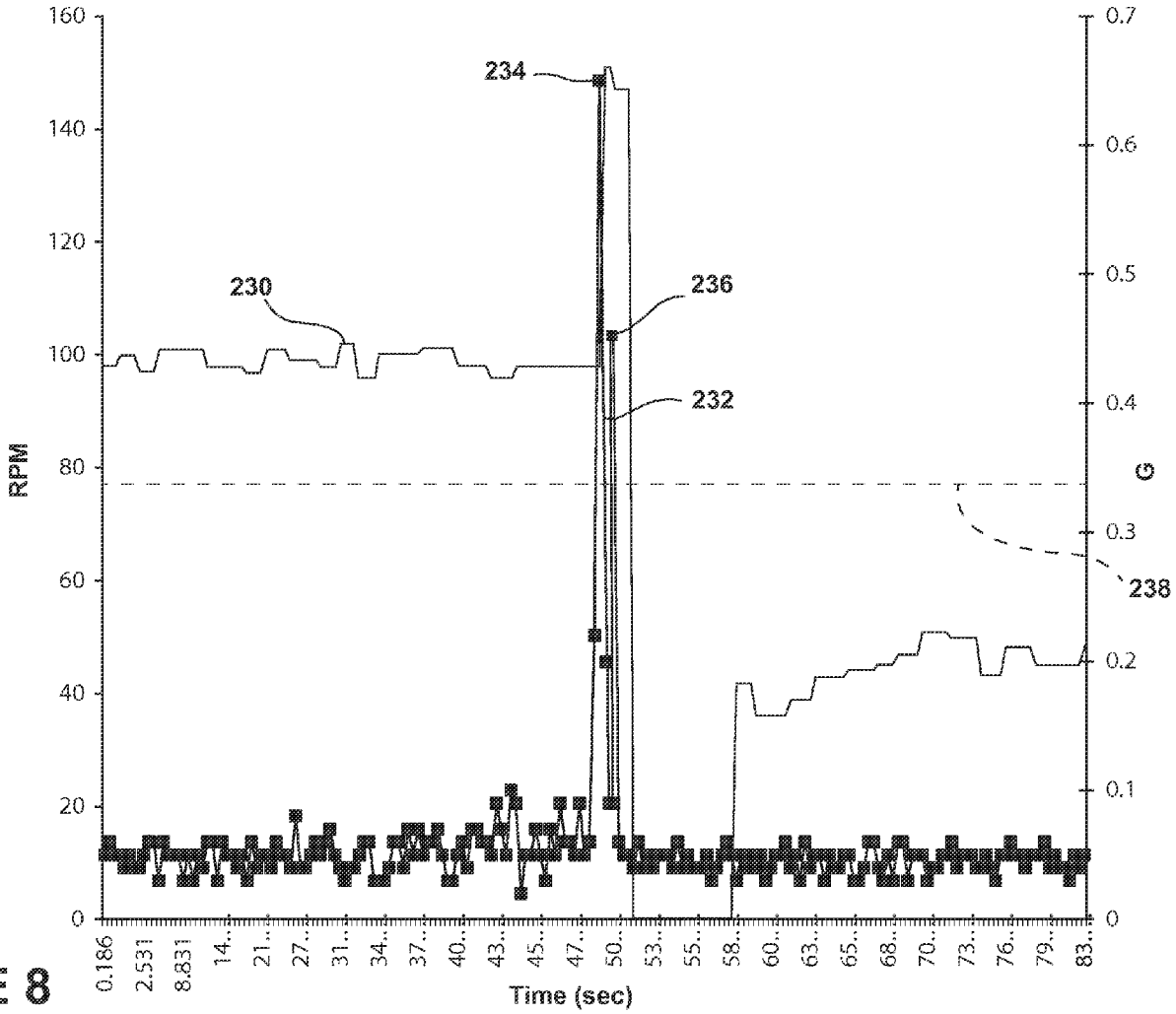
FIG. 8 is a graph illustrating when a double hit would be identified according to an embodiment of the method.

Conversely, FIG. 8 is a graph illustrating when a double hit would be identified according to an embodiment of the method of the invention. Again, a rotational speed 230 of the drum 16 is illustrated along with a signal illustrating the acceleration 232 of the cabinet 12. The magnitude of the acceleration of a first hit 234 and a second hit 236 are each above the predetermined acceleration threshold 238. Further, the frequency of the first hit 234 and the second hit 236 correspond to a rotational frequency of the drum during the resonance speed zone allowing a double hit to be identified. The timing threshold that allows a double hit to be identified may be set in any suitable manner including that the threshold may adjusted by a user of the appliance or by the controller. The timing, which may be an integer or fractional multiple of a rotation correlates to the imbalance location in the rotational motion of the drum 16 and allows the controller 96 to determine whether the hit is caused by the imbalance or is caused by some noise, error, etc.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described.

Current methods utilize threshold acceleration rates to detect a single cabinet hit and determine a need for redistribution of the laundry. If the threshold is set too low, nuisance hits will be detected causing unnecessary redistributions. A nuisance hit may include, for example, when a user drops a laundry hamper on top of the cabinet. If such a hit was considered, then there would be unnecessary redistribution of the laundry or adjustment to the acceleration of the drum. If the threshold is set too high, the machine will begin to "walk" before registering a cabinet hit. The above method utilizes both the magnitude and frequency of the cabinet hits to determine if the controller should take action. Because the timing of the expected cabinet hits is also considered, the magnitude threshold may be set to a lower level to improve performance of the laundry treating appliance because the controller may be certain that the hit is not due to noise or error. Thus, determining a double hit is beneficial as compared to a single hit because it allows for more accurate detection of an imbalanced load. Further, the above described embodiments may utilize a single accelerometer to determine the double hit and output a digital signal to the controller regarding same.

The above described embodiments provide a variety of benefits including the above method may determine when an imbalance is causing a hit with the cabinet such that acceleration of the drum may be ceased and the imbalance may be taken care of before excessive vibration of the laundry treating appliance occurs. That the above method determines a double hit allows the controller to distinguish imbalance caused hits from nuisance hits and allows action to be taken before the laundry treating appliance begins to walk.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a chassis, a tub, a rotatable drum positioned within the tub, and a suspension system mounting the tub to the chassis, with the rotatable drum at least partially defining a treating chamber for receiving laundry for treatment according to an automatic cycle of operation, and the tub, drum, and any laundry in the treating chamber forming a suspended mass in combination with the suspension system, the method comprising:

accelerating a rotational speed of the drum through a resonance speed zone of the suspended mass where an unacceptable imbalance of laundry in the drum will present as the suspended mass contacting a portion of the chassis to define a "hit";

monitoring movements of the chassis during the accelerating;

identifying when the monitored movements satisfy a predetermined threshold, indicative of a hit, for two sequential time segments, which correspond to a rotational frequency of the drum during the resonance speed zone, to identify a double hit; and ceasing the accelerating of the drum upon the identification of a double hit.

2. The method of claim 1 wherein the resonance speed zone comprises a zone between 100 and 300 revolutions per minute of the drum.

3. The method of claim 1 wherein the monitoring the movements of the chassis comprises monitoring the acceleration of the chassis.

4. The method of claim 3 wherein the monitoring the acceleration of the chassis comprises receiving output from an accelerometer coupled with the chassis.

5. The method of claim 1 wherein the predetermined threshold includes a predetermined acceleration magnitude.

6. The method of claim 1 wherein the resonance speed zone comprises speeds causing side-to-side movement of the suspended mass.

7. The method of claim 1 wherein the identifying includes determining a frequency of the hits.

8. The method of claim 1, further comprising reversing a rotational direction of the drum after the accelerating has been ceased.

9. The method of claim 1, further comprising redistributing the laundry within the drum after the accelerating has been ceased.

10. The method of claim 1 wherein ceasing the accelerating of the drum comprises stopping rotation of the drum.

11. The method of claim 1 wherein the two sequential time segments include a first time segment corresponding to a single rotation of the drum and a second time segment corresponding to a single rotation of the drum.

12. The method of claim 1 wherein a first of the two sequential time segments correlates to two, sequential rotations of the drum.

13. The method of claim 12 wherein a second of the two sequential time segments correlates to a single rotation of the drum.

* * * * *